US005122108A

United States Patent [19]

Segalowitz et al.

[11] Patent Number: 5,122,108

[45] Date of Patent: Jun. 16, 1992

[54] METHOD AND APPARATUS FOR APPLYING A TAB TO THE EDGES OF A MAILER TO HOLD THE SAME TOGETHER

[75] Inventors: Ivar R. Segalowitz, Great Neck; Horacio A. Truffa, Farmingdale, both of N.Y.

[73] Assignee: J.A.D. Enterprises of New York, Inc., Farmingdale, N.Y.

[21] Appl. No.: 734,236

[22] Filed: Jul. 22, 1991

[51] Int. Cl.[5] ..... B65H 35/06; B65H 35/07

[52] U.S. Cl. ..... 493/344; 493/347; 493/353; 493/356; 156/520; 156/521; 156/442.1; 53/228; 53/229

[58] Field of Search ..... 53/228, 229, 230; 156/442.1, 442.2, 519-521; 493/212, 214-216, 223, 231, 254, 344, 347, 353, 356

[56] References Cited

U.S. PATENT DOCUMENTS

| | | | |
|---|---|---|---|
| 2,064,658 | 12/1936 | Grieb | 156/521 |
| 2,346,142 | 4/1944 | Anderson | 156/521 |
| 3,989,579 | 11/1976 | Sheldon | 156/499 |
| 4,160,687 | 7/1979 | Spear | 156/487 |

*Primary Examiner*—Bruce M. Kisliuk
*Assistant Examiner*—Jack Lavinder
*Attorney, Agent, or Firm*—Cobrin, Feingertz & Gittes

[57] ABSTRACT

An apparatus for automatically applying a pressure-sensitive tab to the edge of a mailer which includes a feed spool of pressure-sensitive tape. The pressure-sensitive tape is fed through a tape slot of a tape guide block from where it is wound upon a driven windup spool. A pneumatically driven (or, if desired, solenoid driven) punch and die arrangement is positioned so that upon actuation, the die cuts a circular segment of the tape and wiper arms apply the circular cut tape segment to the edges of a mailer. This can be done while the edges of the mailer are stationary or moving parallel to the direction of the tape.

18 Claims, 8 Drawing Sheets

METHOD AND APPARATUS FOR APPLYING A TAB TO THE EDGES OF A MAILER TO HOLD THE SAME TOGETHER

FIELD OF THE INVENTION

This invention relates to a method and apparatus for applying a tab to the edges of a mailer.

BACKGROUND OF THE INVENTION

Mailers are today a well-known and common method of merchants transmitting their commercial messages to potential customers, usually at their places of residence. Typically a mailer will be formed from a cut segment of a continuous printed web of paper that is folded mid-length and has a tab applied to the edges of the sections parallel to the fold line. Normally, the tab will be made of paper and have an adhesive on the surface thereof which is affixed to the edges of the sections of the mailer which are parallel to the fold line thereby preventing each section from moving relative to the other section.

With mailers being used in increasing volumes of numbers, it is important that one be able to apply the tab to the edges of the overlying sections of the mailer as rapidly as possible so that the cost of this step will be as inexpensive as possible. The prior art has recognized the need to apply tabs to the edges of products as well as certain other related fields of endeavor as evidenced by a number of prior art patents of which the inventors of the instant application are aware, to wit, the following:

U.S. Pat. No. 3,545,670
U.S. Pat. No. 3,898,122
U.S. Pat. No. 3,939,034
U.S. Pat. No. 3,960,646
U.S. Pat. No. 4,009,070
U.S. Pat. No. 4,208,976
U.S. Pat. No. 4,235,031
U.S. Pat. No. 4,394,206
U.S. Pat. No. 4,504,336
U.S. Pat. No. 4,598,860
U.S. Pat. No. 4,824,427
U.S. Pat. No. 4,869,775
U.S. Pat. No. 4,944,720

It is further noted that current postal regulations mandate the application of one or two tabs to the edges of a mailer, with the number of tabs determined by the weight of the mailer. Current available equipment does not satisfactorily perform this function.

SUMMARY OF THE INVENTION

It is therefore an object of the present invention to provide an improved method and apparatus for applying tabs to the overlying sections of a mailer.

Briefly, the foregoing and other objects are accomplished by having a spool of pressure-sensitive tape fed through a tape slot of a tape guide block. The tape is wound upon a driven wind-up spool. A pneumatically driven (or, if desired, solenoid driven) punch and die arrangement is positioned so that upon actuation, the die cuts a circular (or other shape) segment of the tape and wiper arms apply the circular cut tape segment to the edges of a mailer. This can be done while the edges of the mailer are stationary or moving parallel to the direction of the tape.

THE DRAWINGS

DESCRIPTION OF THE PREFERRED EMBODIMENTS

Figure 1:
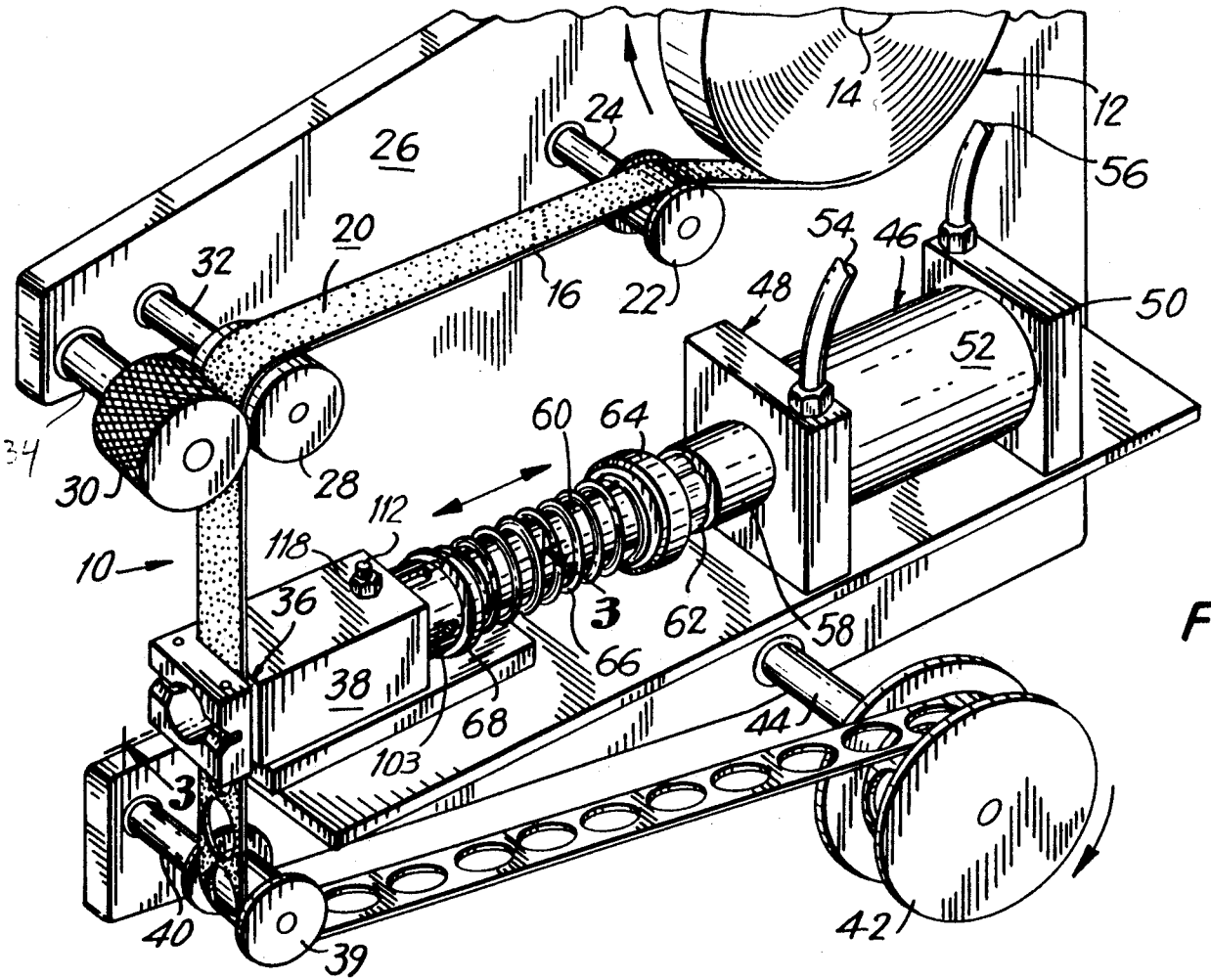
FIG. 1 is a perspective view of the present invention showing a pressure-sensitive tape being fed through the mechanism of the present invention.

In FIG. 1 of the drawings, a tab applicator 10 according to the present invention is shown and includes a feed spool 12. Spool 12 rotates about a fixed shaft 14 and wound around spool 12 is a tape 16 which has a pressure-sensitive adhesive 20 on one side—to wit, the side which is in contact with the segment of tape immediately interior to it. The type of pressure-sensitive adhesive that can be used will be apparent to those having ordinary skill in the art.

Alternatively, a water (or other ingredient) activated adhesive can be used, with the adhesive activating ingredient being conventionally applied to the adhesive on the tab prior to the tab being cut from the strip.

Tape 16 is passed about an idler roller 22 which idler roller guides the tape 16. Idler roller 22 is freely rotatable about idler roller guide shaft 24 which is affixed to housing 26.

From idler roller 22 tape 16 passes between guide roller 28 and knurled roller 30. Guide roller 28 is an idler roller and rotates about an guide roller support shaft 32 which is affixed to housing 26.

Knurled roller 30 is a driven roller with the drive means therefor not being shown in the drawings. Knurled roller 30 is driven by knurled roller drive shaft 34 which is driven by drive means that is not visible in the drawings. Tape 16 passes through a tape slot 36 in a tape guide block 38 where a circular tab is cut therefrom, as will hereinafter be described.

From tape slot 36 tape 16 passes around an idler guide roller 39 which is freely rotatable about guide roller support shaft 40 which guide roller support shaft is affixed to housing 26. From passing about idler guide roller 39 tape 16 is wrapped about driven take-up spool 42 which take-up spool includes a drive shaft 44. Means are provided to rotate drive shaft 44 and take-up spool 42 so that as take-up spool 42 rotates, the tape is wound thereabout.

Still referring to FIG. 1 of the drawings, a pneumatically driven piston and cylinder arrangement 46 is illustrated between end plates 48 and 50. Piston and cylinder arrangement 46 specifically includes a cylinder 52 within which is located a piston which is double acting. Air lines 54 and 56 are connected respectively to end plates 48 and 50 and control the application of pressure or vent to the opposite sides of the piston. The piston located within a cylinder 52 is a double acting piston in that it can be driven under the influence of pressurized air in either of two opposed directions. It is to be appreciated that while a piston and cylinder arrangement have been shown for practicing the present invention, a solenoid arrangement can be utilized if desired.

As can be seen in FIG. 1, a piston rod 58 extends through end plate 48 and can move in either of two opposed directions in conjunction with movement of the piston within cylinder 52.

Piston rod 58 at its left end, which is visible in FIG. 1, is internally threaded and the right end of a rod 60 (FIG. 3) has external threads which are threaded into the internal threads of piston rod 58. A lock nut 62 abuts against the left face of piston rod 58 and is tightened thereagainst to prevent undesired rotation of rod 60 relative to piston rod 58.

Figure 3:
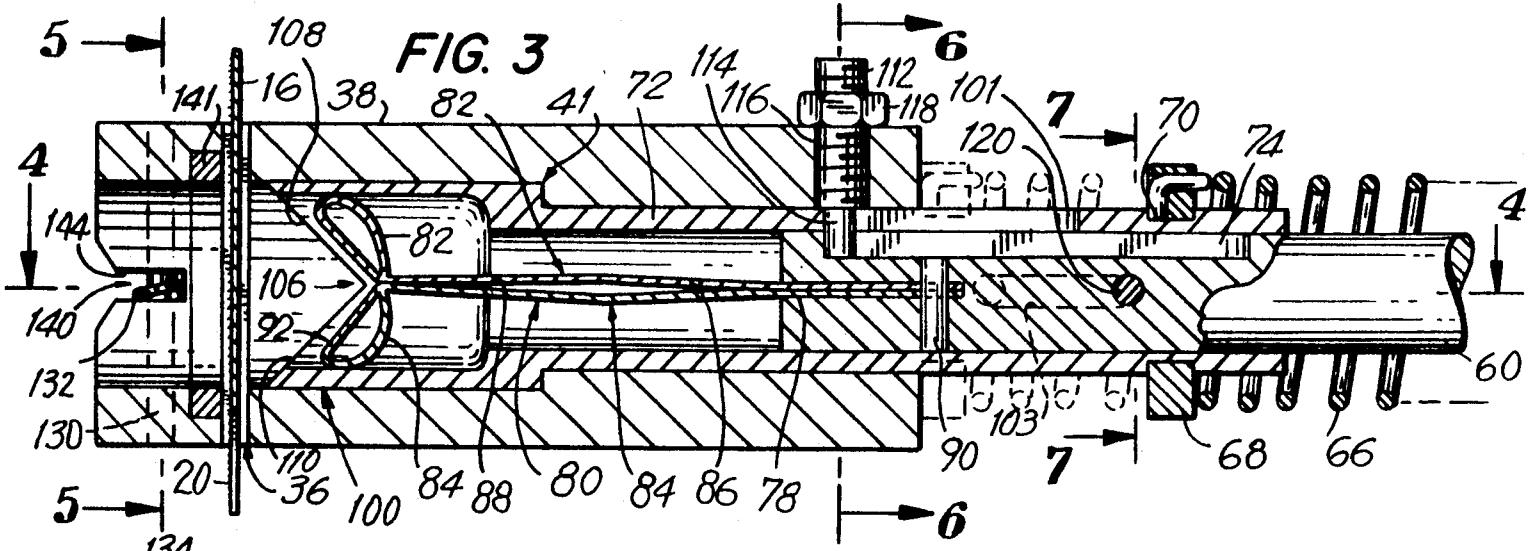
FIG. 3 is a sectional view taken substantially along the line 3—3 of FIG. 1.

Affixed to rod 60 (FIG. 1) is a spring collar 64 and the means of affixing collar 64 to rod 60 can be conventional. A compression spring 66 has one end abutting against spring collar 64, surrounds rod 60 and has its other end abutting retaining Ring 68 mounted in a grove on cylindrical barrel 98. The free end on the leftmost portion of compression spring 60 is fixedly received within an opening in collar 68 as can be seen in FIG. 3. The collar 68 is received within an annular slot 70 of punch member 72.

Figures 2, 11A:
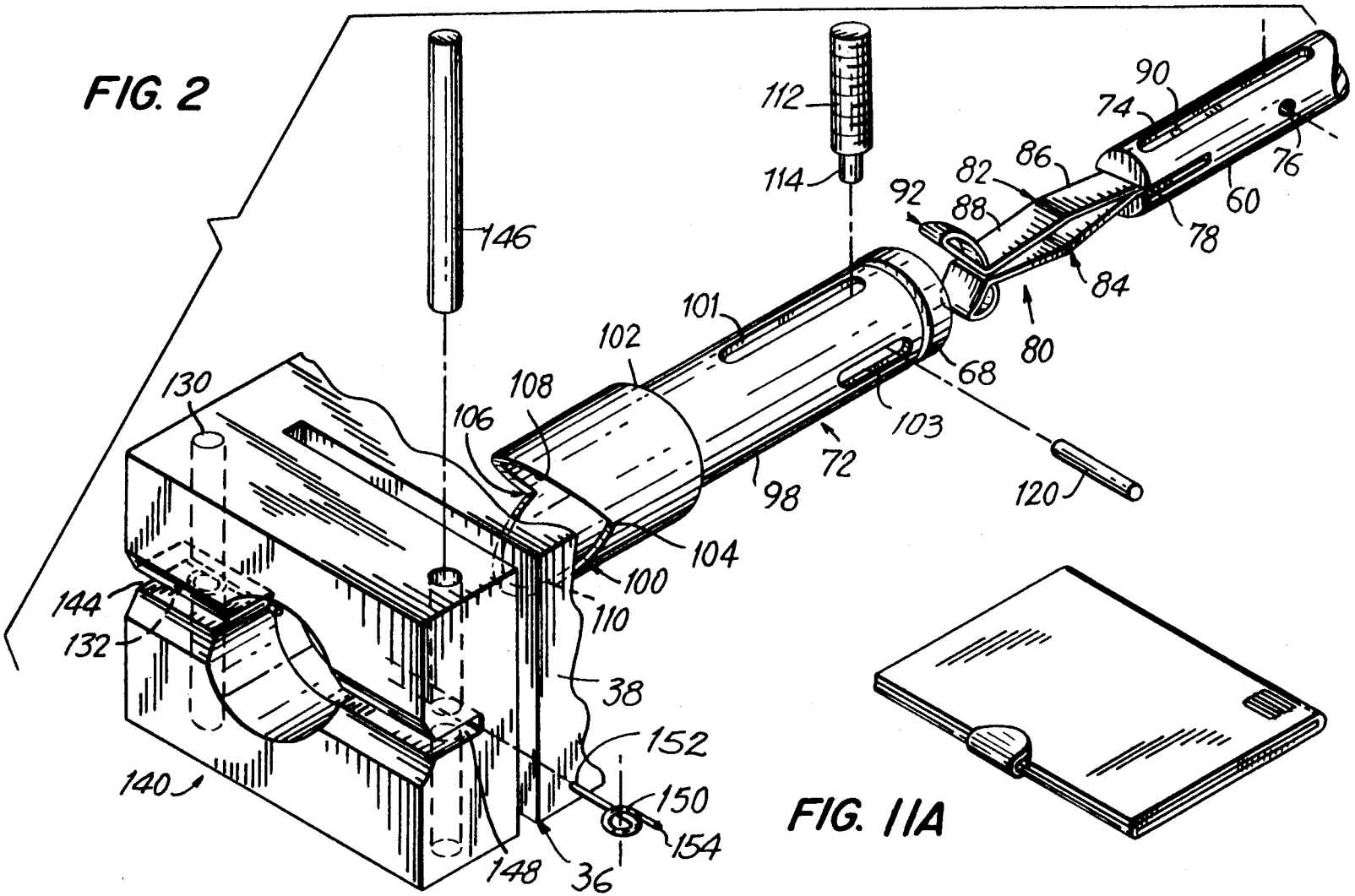
FIG. 2 is an exploded view of the present invention.
FIG. 11 shows the retraction of the wiper mechanism after the tab has been applied to the edges of a mailer and FIG. 11A shows the tab applied to the mailer.

The left end of rod 60 can best be seen in FIGS. 2 and 3. Located at the left end of rod 60 on the top portion is a position slot 74 which extends parallel to the longitudinal axis of rod 60. A position hole 76 extends from one side of rod 60 perpendicular to the longitudinal axis thereof through the other side and serves a purpose that will hereinafter be described. An internal slot 78 is at the leftmost portion of rod 60. A tab wiper mechanism 80 is provided and can be seen in FIG. 2 as well as various other figures. The tab wiper mechanism includes wiper blades 82 and 84 which are made of spring steel. Inasmuch as the wiper blades are identical to each other except for their orientation, a description of one wiper blade will suffice for an understanding of the present invention.

Wiper blade 82 includes flat sections 86 and 88 which are angled with respect to each other. The portion of flat section 86 that is furthest from flat section 88 is received within slot 78 and together with the corresponding portion of wiper element 80 is secured within slot 78 by a lock (or roller) pin 90 which extends therethrough and can be seen in FIG. 3. (In the embodiment of FIG. 14, two lock pins are utilized, with the second lock pin identified by reference numeral 91.) Lock pin 90 extends through the forward portion of rod 60 and through both segments of the wiper mechanism to secure the wiper mechanism relative to the rod. The forward portion of wiper blade 82 is defined by a wiper head 92 which is flared outwardly relative to flat section 88 while having the distal end thereof wrapped around itself. The wrapping around of the distal end of the wiper blade is optional and not mandatory for the practice of the present invention.

Punch member 72 includes a cylindrical barrel 98 and a cutting die head portion 100. Cylindrical barrel 98 includes a longitudinal top slot 101 and longitudinal opposed side slots 103, only one of which can be seen in the drawings. Die head 100 intersects with cylindrical barrel 98 at shoulder 102. The forward end of die head 100 includes a cutting die 104 which die has an opening 106. Opening 106 is defined by an upper arcuate cutting edge 108 and a lower arcuate cutting edge 110 with the rear portion of the respective arcuate cutting edges intersecting with each other. As can be seen in FIG. 3, the forward portion of rod 60 from which wiper blade mechanism 80 extends is received within cylindrical barrel 98 with the wiper head received within die head 100.

A screw 112 includes a position pin 114 at its bottommost portion. Screw 112 is screwed through a threaded opening 116 in tape guide block 38 with pin 114 extending through slots 101 and 74 to prevent rotation of each of the members which include said slots about their longitudinal axis and limit their travel. It is noted that slot 101 is of a lesser length than slot 74. Nut 118 is a lock nut and by abutting against tape guide block 38 prevents lock screw 112 from freely rotating.

A lock pin 120 (FIG. 2) extends through slots 103 and hole 76 so that relative rotation of the punch and die and rod 60 members is prevented.

Guide block 38 includes a stepped internal bore having a shoulder 41.

In FIGS. 2, 3, 4 and 5 of the drawings (as well as other figures), the folding mechanism for a tab is illustrated. A position pin 130 extends through tape guide block 38 in a vertical and direction surrounding said position pin is a coiled spring 132 having spring arms 134 and 136. Spring arm 136 normally will extend into opening 140 of block 38 and spring arm 134 abuts said guide block such that spring arm 136 can be rotated in a clockwise direction as viewed in FIG. 4 out of the path of travel through opening 140. Spring 132 is positioned within a horizontal slot 144 (FIG. 2) which slot is on one side of opening 140 of block 38. In a similar fashion, a position pin 146 extends through block 38, as can be seen in FIG. 2, through a slot 148 which is on the other side of opening 138 as is slot 144 and through the bottom portion of block 38. Received within slot 148 is a spring 150 which has a spring arm 152 and a further spring arm 154. Spring arm 136 and 152 extend into opening 140 and upon a force being applied to each of the spring arms in a direction of right to left as viewed in FIG. 4, the spring arms 136 and 152 will assume the dotted positions respectively shown for these spring arms.

A female die 141 is formed on the inside part of opening 140 and can be, if desired, designed for removal and replacement when wear necessitates the replacement.

The operation of the present invention will now be described.

Spool 12 will be loaded with pressure-sensitive tape which will pass about idler roller 22 between idler roller 28 and driven knurled roller 30 through slot 36 of guide block 38 about idler roller 39 and onto take-up spool 42. Take-up spool 42 is driven, as is knurled roller 30, so as to ensure tape 16 is advanced through the mechanism at a proper rate of speed. A folded over mailer will be advanced so that the edges of the mailer parallel to the fold line pass immediately adjacent slots 144 and 148 while being parallel to a plane extending through said slots. Normally a mailer transport mechanism will position a mailer so that its edges which are parallel to the fold line are immediately adjacent slots 144 and 148 where it will be held stationary while a tape is applied thereto. Alternatively, the tape can be applied to the edges of the mailer on the fly—i.e., as the mailer is moving past slots 144 and 148.

When the edges of the sections of the mailer opposite the fold line are immediately adjacent slots 144 and 148 while being parallel thereto, initially the piston in cylinder 52 will be in the retracted rightmost position. Upper arcuate cutting edge 108 and lower arcuate cutting edge 110 of die 104 will be spaced from tape 16, as shown in FIG. 3. Spring 66 will not be under compression. In addition, punch and die member 72 will be in the position shown in FIG. 3 and rod 60 will be in its rightmost position such that pin 114 will be abutting the left portion of slot 74 and the left portion of slot 102.

At this time, pressurized air will be directed through line 56 to the right end of cylinder 52 while line 54 will be vented. A conventional valve can be used to control the flow of pressurized air to and from lines 54 and 56.

Figure 4:
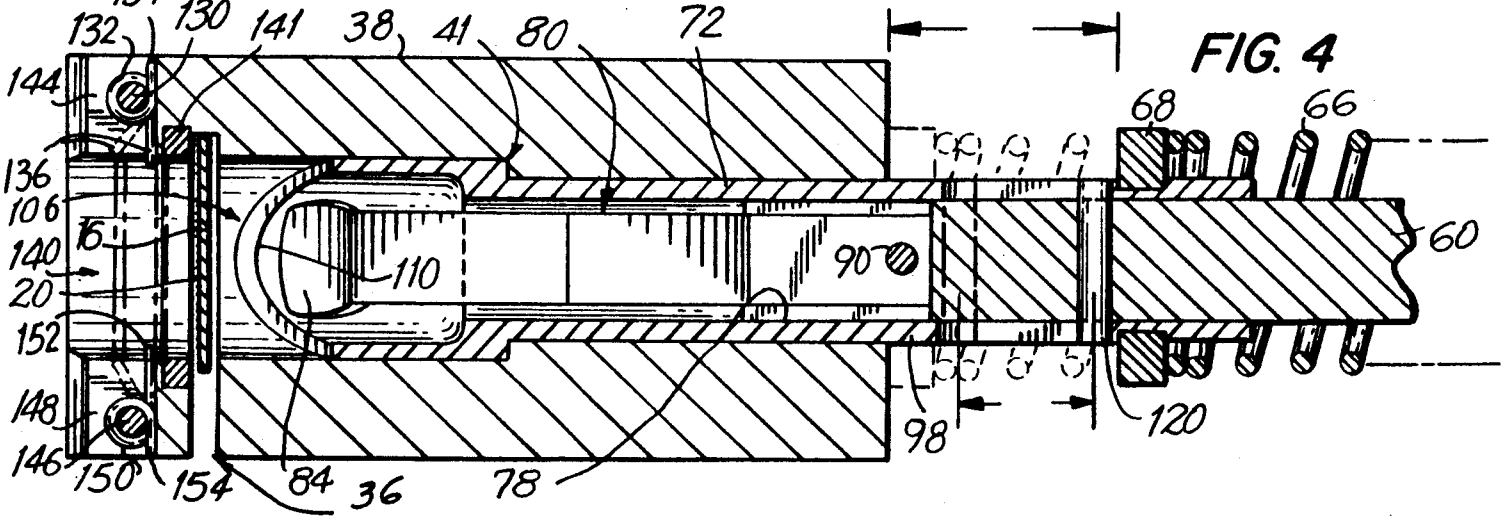
FIG. 4 is a sectional view taken substantially along the line 4—4 of FIG. 3.
Figure 5:
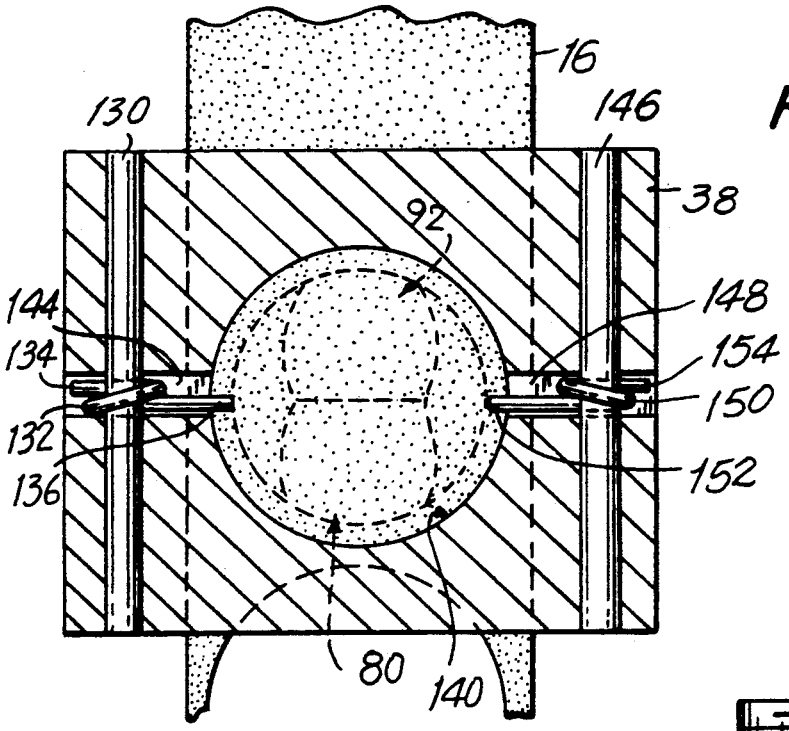
FIG. 5 is a sectional view taken substantially along the line 5—5 of FIG. 3.
Figure 6:
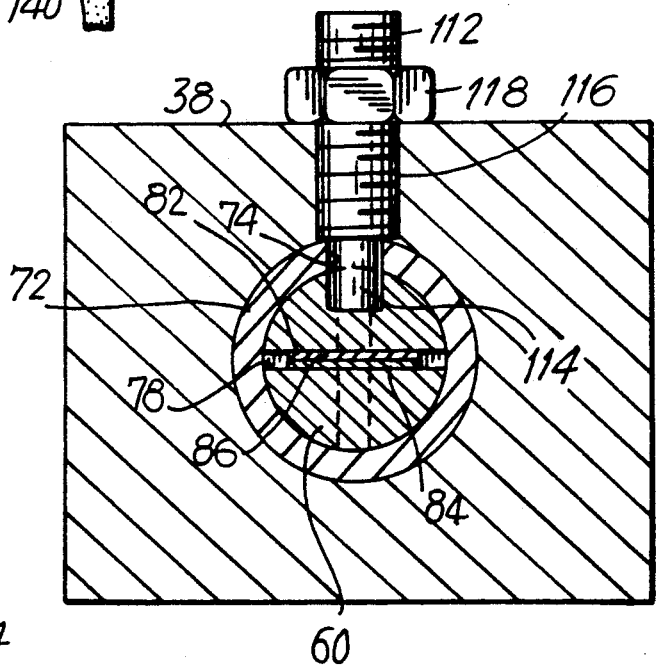
FIG. 6 is a sectional view taken substantially along the line 6—6 of FIG. 3.
Figure 7:
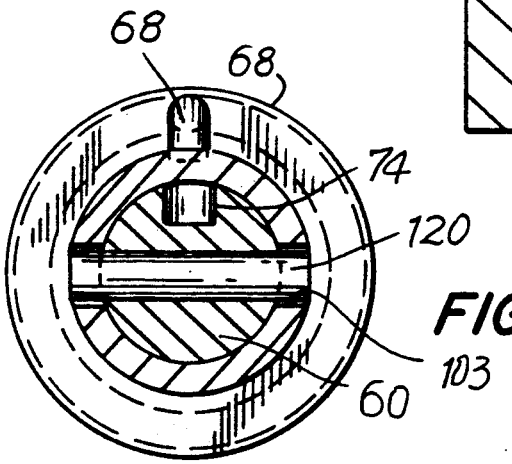
FIG. 7 is a sectional view taken substantially along the line 7—7 of FIG. 3.
Figure 8:
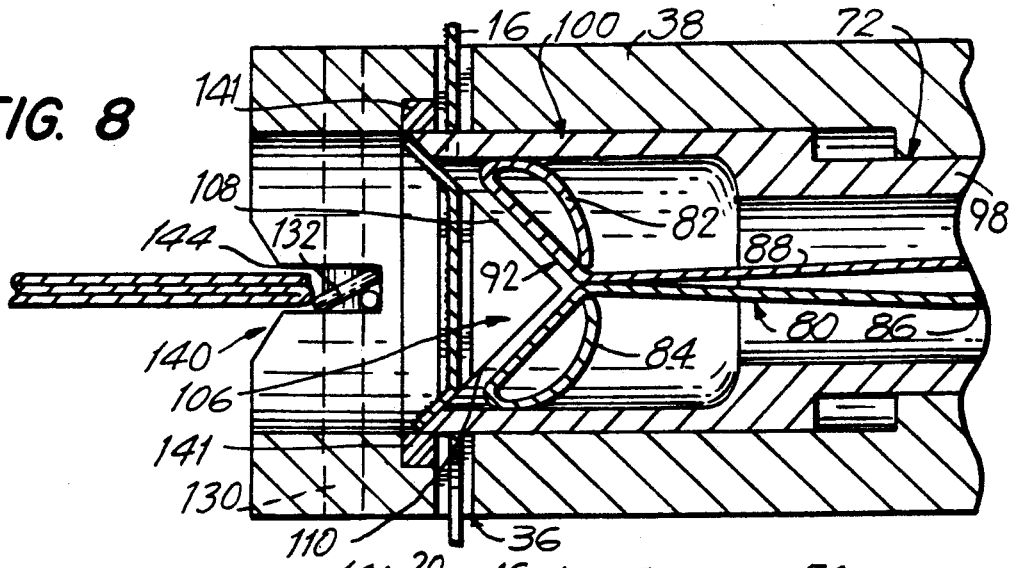
FIG. 8 is a sectional view of the punch and die mechanism of the present invention as the tab is being cut from the strip of pressure-sensitive tape.
Figure 9:
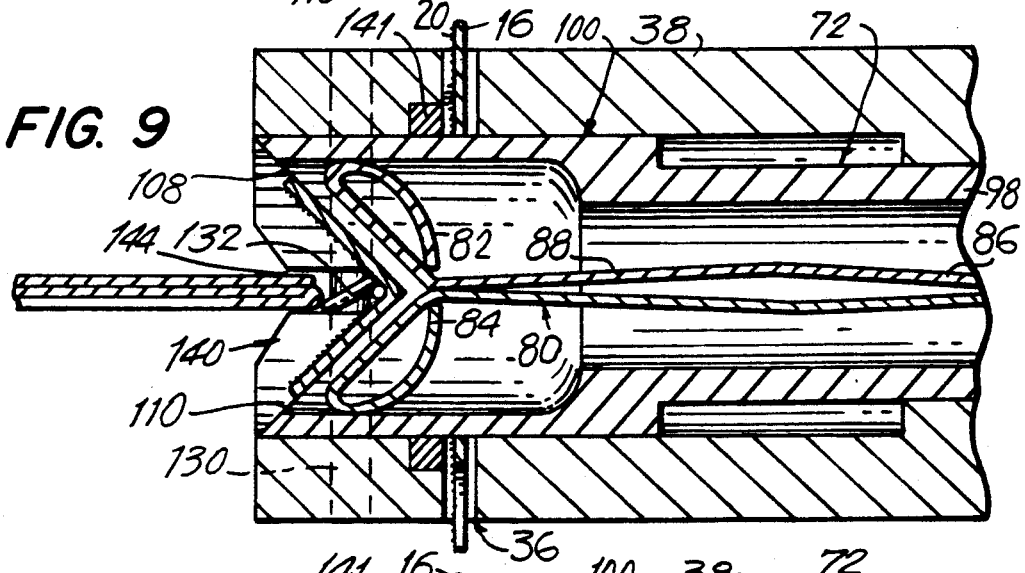
FIG. 9 is a sectional view of the punch and die mechanism of the present invention just prior to the removed cut paper tab being applied to the edge of a mailer.
Figure 10:
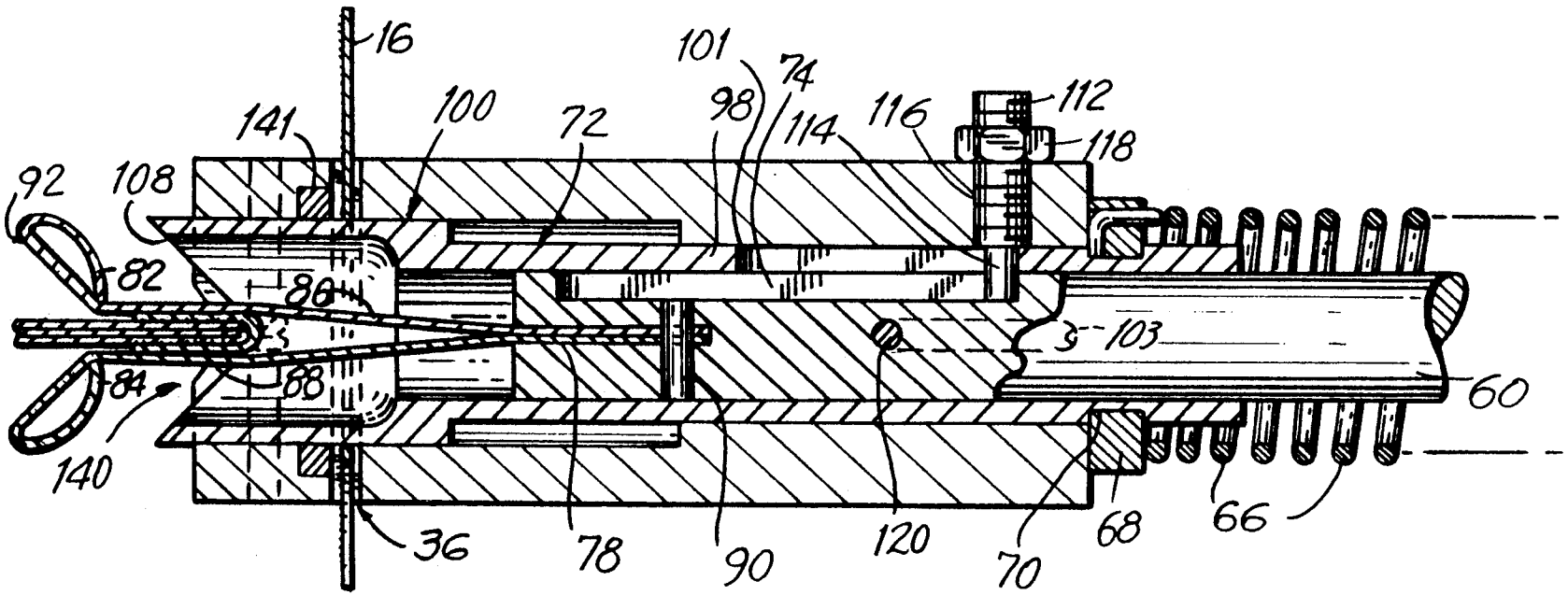
FIG. 10 is a sectional view of the punch and die mechanism of the present invention as the wiper mechanism applies a removed tab to the edges of a mailer.

As pressurized air is directed through line 56, the piston within cylinder 52 is moved to the left causing rod 58 and rod 60 likewise to move to the left. Initially, spring 66 will not be compressed but will assume the position shown in dotted lines in FIGS. 3 and 4, at the end of the stroke of the cylinder. Before the spring assumes the position shown in dotted lines in FIGS. 3 and 4, the upper arcuate cutting edge 108 and the lower arcuate cutting edge 110 of punch member 72 will take the position shown in FIG. 8—i.e., cut a circular tab from a pressure sensitive adhesive tape 16 against die 141. The further application of pressurized air to line 56 will result in the gradual compression of spring 66 with the punch member 72 going from the position in FIG. 8 to the position in FIG. 9 and as the spring compresses, the wiper blade mechanism 80 will move from the position of FIG. 8 to the position of FIG. 9 in opening 140. At this time, the cut tab will, as a result of the cutting action, be folded over against opposed spring arms 136 and 152 which point directly at each other while extending into opening 140. This will cause a fold line in the cut tab. Further pressurization of line 56 will result in the punch and die member and wiper blades assuming the position shown in FIG. 10. At this time, it is important to keep in mind that pin 114 and retaining Ring 68 will limit further movement of punch member 72 to the left while allowing further movement of rod 60 to the left. The wiper mechanism as seen in FIG. 10 will wrap the tab around the edges of the mailer while moving the spring fingers out of opening 140 such that spring finger 136 rotates in a clockwise direction as viewed in FIG. 4 to the position shown in dotted lines while spring finger 152 assumes the position shown in dotted lines by rotating in a counterclockwise direction as seen in FIG. 4.

The inherent resiliency of wiper blades 82 and 84 will press the tab against the edges of the mailer so that the adhesive will adhere thereto, as seen in FIG. 11A.

Figure 11:
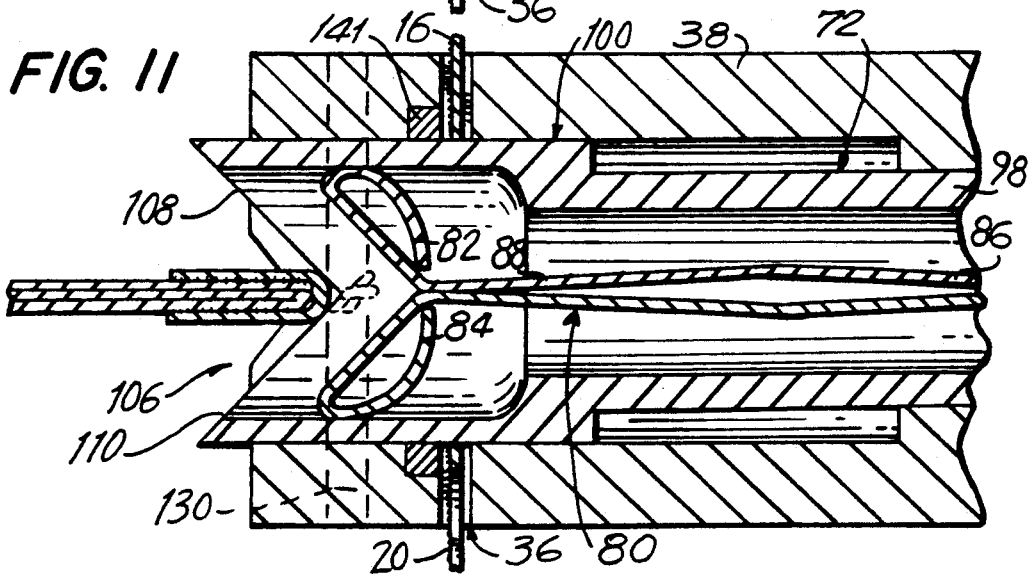

At this time, pressure will be released from line 56 directed to line 54 and the mailer with the tab applied to the edge will be moved from the position shown in the figures away from slots 144 and 148 and a new mailer edge positioned thereon. As pressure is directed to line 54, the mechanism will first take the position seen in FIG. 11 and gradually be restored to the position seen in FIG. 3 and the tape drive mechanism will advance the tape so that the tab that is immediately adjacent to the upper and lower arcuate cutting edges does not have any portions removed therefrom. To accomplish this an intermittent tape drive is provided which is conventional. During the retraction of the punch and die mechanism, spring finger 136 will rotate in a counterclockwise direction and, as viewed in FIG. 4, will assume the position shown in solid lines in FIG. 4. Spring finger 152 will rotate from the position shown in dotted lines in FIG. 4 clockwise to the position shown in solid lines in FIG. 4 and the cycle can then be repeated.

Figure 12:
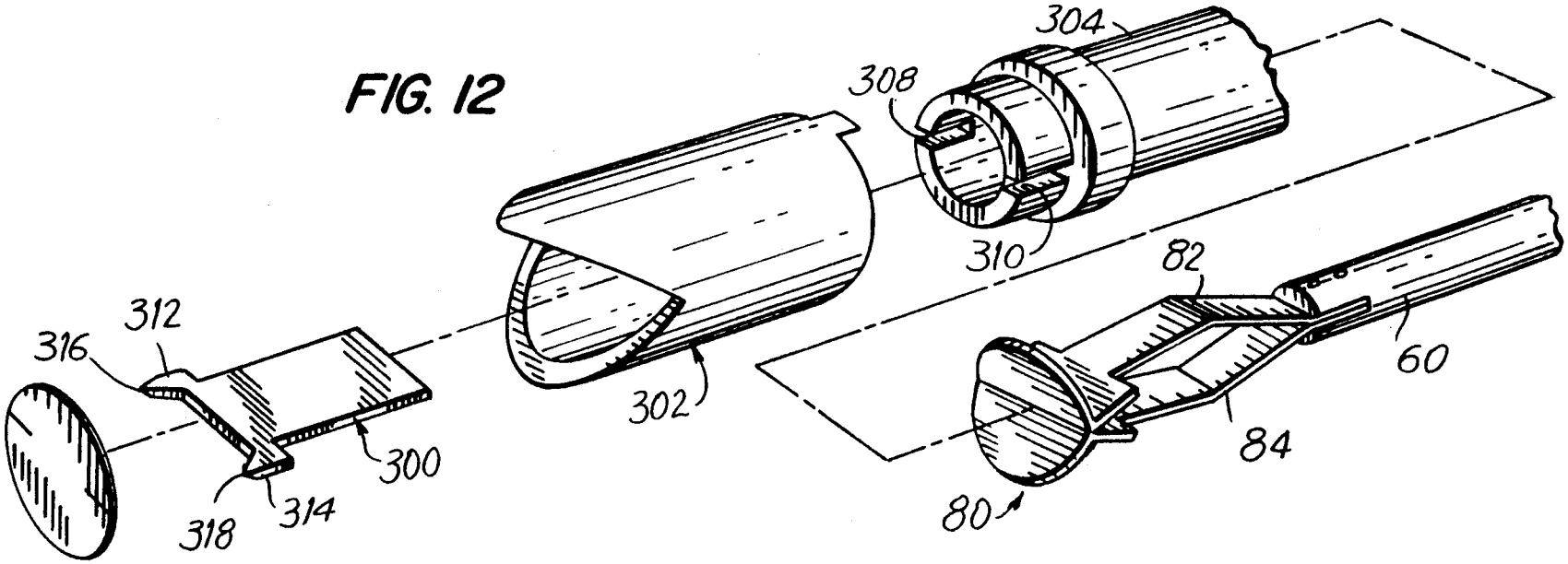
FIG. 12 shows an alternate embodiment of the present invention in exploded form wherein means are provided for perforating the edges of a tab.
Figure 14:
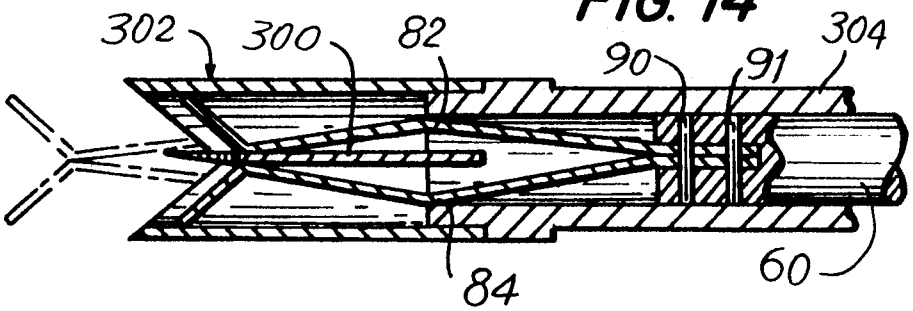
FIG. 14 shows in cross-section how the tab perforator blade of FIGS. 12 and 13 is utilized with the punch and die mechanism of the other embodiment of the present invention.
Figure 13:
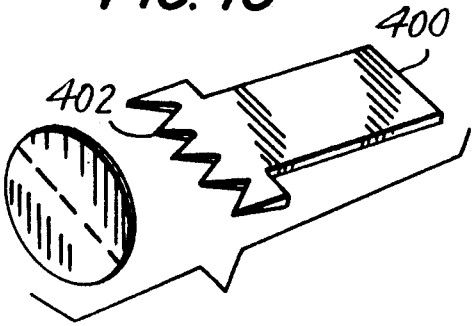
FIG. 13 shows a further alternate embodiment of the present invention wherein the tab is perforated along its diameter.

In FIGS. 12–14, alternate embodiments of the invention are shown which are identical to the previous embodiments but include a cutting instrument. In the FIG. 12 embodiment, the punch member 72 is composed of a separate cutting head portion 302 and a barrel portion 304. Barrel portion 304 includes a circular extension 306 having opposed slots 308 and 310. Circular extension 306 is snugly fit within cutting head portion 302 such that cutting head portion 302 and barrel portion 304 move in unison with each other. A cutting blade 300 extends through head portion 302 and the rear portion of cutting blade 300 is snugly fit and secured in slots 308 and 310. The forward portion of cutting blade 300, as viewed in FIG. 12, includes edge cutters 312 and 314, with each edge cutter including a pointed cutting tip which pointed cutting tips are identified by reference numerals 316 and 318.

Cutting blade 300, as can be seen in FIG. 14, extends between the wiper blades 82 and 84 and serves the function of perforating the edges of a cut tab so that the tab while being strong enough to secure the edges of a mailer will not be so strong that when the sections of the mailer are pulled apart to be separated from each other, the mailer will rip and not the tab.

In FIG. 13, an alternate cutting blade 400 is seen which is identical to cutting blade 300 except the cutting edges are formed by a plurality of cutting teeth 402 with each cutting tooth having a pointed cutting tip which is flanked on opposite sides by a cutting edge. The result of using the cutting blade of FIG. 13 is that a perforated tab as seen in FIG. 13 is obtained.

Figure 15:
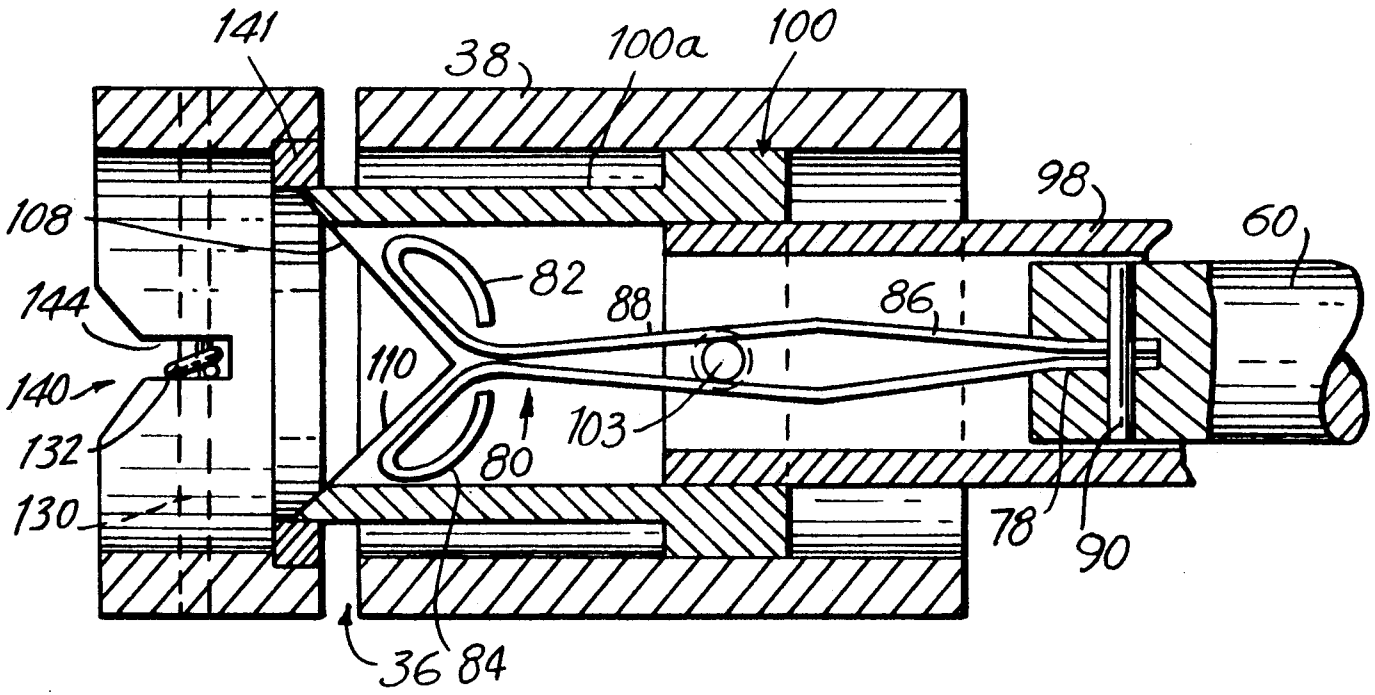
FIG. 15 is another embodiment of the present invention.

In FIG. 15 of the drawings, an alternate embodiment of the present invention is shown wherein cylindrical barrel 98 and cutting head portion 100 are not of one-piece construction. In all other respects, the FIG. 15 embodiment is identical to the earlier described embodiments, except as described herein. Cutting head portion 100 does not include on its outside surface a cylindrical area of a constant cross-section as with the previous embodiments of the present invention. Cutting head 100 has a smaller diameter than the inside surface of guide block 38 so there is a gap between the external surface **100*a* of the cutting head and the interior surface of the guide block. As a consequence, when the adhesive accumulates in this gap, there is space to accommodate the adhesive so that the same does not result in such high friction between the external surface of the cutting head and the interior surface of the guide block such that it is difficult to move the guide block cyclically back and forth. Cylindrical barrel 98 is affixed to cutting head 100 by means of screws that are 180 degrees apart from each other and one of which can be seen in FIG. 15 and which is identified by reference numeral 103. The screws allow the cylindrical barrel to separate from the cutting head 100** so that as wear necessitates the replacement of the cutting head this can be simply done.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

We claim:

1. Apparatus for applying a tab to the edges of at least two sections of a mailer having at least one fold line and wherein the edges are spaced from and are parallel to the fold line, comprising:

a web supply of tape having an adhesive on at least one side thereof;

means for advancing the tape from the supply thereof to a given location adjacent to where the edges of the mailer will be at a predetermined moment of time, with said side of said tape containing said adhesive facing the edges of the mailer;

means for intermittently cutting a segment from the web of tape at the given location;

means for applying the cut segment of tape to the edges of the mailer adjacent the given location to seal the sections to each other; and means for taking up the tape after the segment has been removed from the web of tape.

2. Apparatus according to claim 1, wherein said means for intermittently cutting a segment of the tape at the given location includes a cutting instrument and means for cyclically advancing and retracting said cutting instrument against the tape so as to intermittently cut a segment therefrom.

3. Apparatus according to claim 2, wherein said means for applying the cut segment of the tape to the edges of the mailer adjacent the given location to seal the sections to each other includes means for intermittently applying a force to the cut segment of the tape so that the cut segment of tape is applied to the sections of the mailer.

4. Apparatus according to claim 3, wherein said means for intermittently applying a force to the cut segment of the tape includes wiper means for forcing said cut segment of said tape against the sections of the mailer containing the mailer edge furthest from the mailer fold line, and means for intermittently moving said wiper means along a path of travel toward, past and away from the given location.

5. Apparatus according to claim 4, wherein said means for cyclically advancing said cutting instrument includes an actuator, said actuator movable between an advanced position and a retracted position and means mechanically linking said cutting instrument to said actuator.

6. Apparatus according to claim 5, wherein means mechanically couple said wiper means to said actuator means for enabling said actuator means to control the movement of said wiper means.

7. Apparatus according to claim 5, wherein said actuator includes an actuator rod, said means mechanically linking said cutting instrument to said actuator includes means for allowing said actuator rod to move independently of said cutting instrument and in unison therewith.

8. Apparatus according to claim 7, wherein said means for allowing said actuator rod to move independently and in unison with said cutting instrument includes drive means connected to said actuator rod, said wiper means connected to said drive means and means connecting said cutting instrument to said drive means whereby said cutting instrument moves in unison with said drive means and independently thereof.

9. Apparatus according to claim 8, wherein said connecting means includes a member, said cutting instrument formed at one end of said member, biasing means having a first end and a second end, said first end of said biasing means movable with said drive means, and said second end of said biasing means movable with said member.

10. Apparatus according to claim 9, wherein said biasing means is a compression spring.

11. Apparatus according to claim 9, wherein said member includes a first end and a second end, said cutting instrument being located at said first end of said member, a slot being located at the second end of said member, said drive means including a drive means slot, said slot and said drive means slot being in alignment with each other with said drive means slot having a greater dimension than said slot, a housing surrounding said member, and means attached to said housing and extending through said slot and said drive means slot for limiting the path of travel of said member and said drive means.

12. Apparatus according to claim 11, wherein said housing includes an opening adjacent the given location and means extending into said opening for folding the cut segment of tape about a fold line.

13. Apparatus according to claim 12, wherein said extending means includes means about which a cut segment of tape can be placed and as pressure is applied thereto, the extending means moves out of said opening.

14. Apparatus according to claim 13, wherein said extending means includes a pair of flexible spring fingers extending into said opening and in the path of travel of the cut segment of tape, means affixing each spring finger to said housing while allowing the spring fingers to be pivoted out of said opening.

15. Apparatus according to claim 1, further including means for perforating the cut segment of tape.

16. Apparatus according to claim 15, wherein said means for perforating the cut segment of tape includes means for perforating the edges thereof.

17. Apparatus according to claim 15, wherein said means for perforating the cut segment of tape includes means for forming a series of perforations extending across the cut segment of tape.

18. Apparatus according to claim 15, wherein said perforating means includes a perforating blade, said perforating blade movable with said means for applying the cut segment of tape to the edges of the mailer adjacent the given location to seal the sections to each other.

* * * * *